United States Patent [19]

Adams et al.

[11] Patent Number: 4,784,164

[45] Date of Patent: Nov. 15, 1988

[54] SMOKING ROD WRAPPERS AND COMPOSITIONS FOR THEIR PRODUCTION

[75] Inventors: Brian Adams, Newtown Abbey; Shane C. Browning, Co. Antrim; Linda Cunningham, Co. Armagh, all of Ireland

[73] Assignee: Gallaher Limited, England

[21] Appl. No.: 117

[22] Filed: Jan. 2, 1987

[30] Foreign Application Priority Data

Jan. 7, 1986 [GB] United Kingdom ..... 8600259
Aug. 27, 1986 [GB] United Kingdom ..... 8620698

[51] Int. Cl.[4] ..... A24D 1/02
[52] U.S. Cl. ..... 131/365; 131/336

[58] Field of Search ..... 131/365, 336

[56] References Cited

U.S. PATENT DOCUMENTS 3,473,535 10/1969 Stahly ..... 131/336

*Primary Examiner*—V. Millin
*Attorney, Agent, or Firm*—Andrus, Sceales, Starke & Sawall

[57] ABSTRACT

A smoking rod wrapper material has porosity apertures which are partially or fully blocked by a coating of a heat-removable, porosity-reducing composition. The composition melts as the burning tip of the smoking rod approaches to increase the porosity of the wrapper.

31 Claims, No Drawings

SMOKING ROD WRAPPERS AND COMPOSITIONS FOR THEIR PRODUCTION

It is well known that the burn and smoke characteristics of a smoking rod are affected by the porosity of the rod wrapper. The wrapper typically is a fibrous material which normally has relatively low porosity, e.g., in the range 20 to 200 Coresta, the porosity being due to the inter-fibre passages within the wrapper. Due to the relatively low porosity of the wrapper a substantial amount of the air that is drawn into the mouth through the rod is drawn in through the burning tip of the rod, but some of the air that enters the mouth is drawn in through the wrapper or, in filter tip cigarettes, often through the filter.

It has been proposed to vary the porosity of the wrapper along the length of the wrapper either by providing a coating of porosity-reducing composition over part of the length of the wrapper or by providing perforations through the wrapper over part or all of its length.

Thus, in U.S. Pat. No. 3,911,932 a wrapper having an initial porosity of about 15 to 30 Coresta (20 to 60 seconds Greiner) is coated at the burning cone end with a film-forming, porosity-reducing polymeric material to give a porosity of around 5 Coresta (120 to 300 seconds Greiner). The purpose of reducing porosity near the burning tip is to increase the tar in the smoke. Unfortunately it also increases the carbon monoxide and, in particular, can increase the ratio of carbon monoxide to tar. The low porosity at the wrapper close to the burning tip inhibits free burn (burn of the rod when air is not drawn through the rod by the smoker).

The material that is coated at the burning tip end is applied as a continuous coating and the porosity-reduction due to this material apparently is intended to persist substantially up until the moment when the wrapper coated with the material is burnt.

When the wrapper is provided with perforations these generally result in the wrapper, in the perforated area, having porosity of, for instance, 1,000 to 10,000 Coresta. Although this can be valuable at certain positions relative to the burning tip it is generally undesirable that the wrapper should have this porosity along its entire length at the start of the burning of the rod and so it is known to partially or fully block the perforations by a coating of a heat-removable porosity-reducing composition. Thus in theory the ventilation perforations are opened by the approach of the burning tip and so there is high porosity close behind the burning tip but relatively low porosity throughout the remainder of the wrapper.

In U.S. Pat. No. 2,992,647 holes are provided which can be of any shape or size. Round holes of 100 to 150 μm are mentioned, as are openings of widely varied shape and having dimensions of 1 to 3 mm, 100 to 300 μm and 10 to 50 μm. The apertures are present to reduce the temperature in the rod and so are provided over substantially the entire length of the rod. Materials that are mentioned for blocking the apertures are polyethylene, cellulose compounds and mono-sodium phosphate, especially ethyl cellulose alone, mono-sodium phosphate alone, and blends thereof.

In U.S. Pat. No. 3,511,247 the use of cellular or bubble coatings of thermoplastic materials is proposed, in particular the use of ethyl cellulose or other film formers preferably in combination with a material that will lower the softening point of the coating.

In U.S. Pat. No. 3,526,904 it is proposed to use a water soluble material so that opening of the holes is caused by the moisture laden smoke. Materials that are proposed are dextrin, starches, gums and synthetic polymers, and in all the examples a film forming polymer, optionally combined with a small amount of dextrin, is used. In U.S. Pat. No. 3,699,973 it is stated that the prior patents did not always give effective opening of the apertures during use and so the polymeric material used for blocking the hole is irradiated so as to facilitate breakdown of the film. In U.S. Pat. Nos. 3,526,904 and 3,699,973 apertures having maximum dimensions of 125 to 250 microns are mentioned. In U.S. Pat. No. 3,739,785 gross slits are formed.

In GB No. 1,439,778 apertures having sizes ranging from 300 to 450 μm are provided and are blocked by an ethylene vinyl acetate (EVA) copolymer composition that, as in U.S. Pat. No. 3,511,247, includes an additive that will depress the softening point. Various additives are mentioned including organic esters, non-volatile hydrocarbons, natural waxes, fatty acids and their soaps, and fatty alcohols. The amount of additive can be up to 350% by weight of the copolymer (77.8% additive 22.2% copolymer) but is said to preferably be from 25 to 100% by weight of the copolymer (i.e., from 20 to 50% additive and from 80 to 50% copolymer). Inorganic filler can also be included.

Although the porosity reducing compositions may be capable of being dissipated sufficiently by heat to result in some degree of opening of large apertures none of them dissipate sufficiently to open smaller apertures, such as below 100 μm maximum dimension nor do they allow the apertures to open sufficiently ahead of the burn line to provide optimum ventilation. This failure to open the apertures is not surprising since many of the materials that are alleged to be suitable for use as heat dissipatable compositions, e.g., ethyl cellulose, are the same materials as are described in U.S. Pat. No. 3,911,932 for reducing porosity adjacent to the burning tip. Similarly, in U.S. Pat. No. 4,607,647 EVA is used as a material that renders paper impermeable adjacent to the burn line.

A different, non-polymeric, material, mono-sodium phosphate, was mentioned in U.S. Pat. No. 2,992,647, but the characteristics of this material are such that, upon the approach of the burning tip, it forms a highly viscous liquid which remains on the surface of the wrapper and around the wrapper and so even though it has a low melting point and is not film forming its melt rheology is such that it does not open small perforations but remains as a molten film that blocks them. Also it is a burn inhibitor and leaves a black ash.

Relatively high rates of coating of the porosity reducing compostion have been proposed in the literature and have probably been essential because of the relatively large aperture size. However this creates another problem in that these large amounts, upon melting, tend to stain the wrapper when they melt.

It might be thought possible that adequate blocking and easy opening could be achieved by the use of a very low melting composition, e.g., that melts at about 25° C. However this incurs the disadvantage that opening may occur during manufacture of storage, especially when exposed to summer heat or body heat. The wrapper may therefore be stained and/or the perforations opened even before the smoking rod is lit. Although, in practice, consideration has so far only been given to the blocking of relatively large apertures these large apertures do incur a further disadvantage in that, after opening, they are so large that smoke may escape through them during the free burn state and this is undesirable.

It would be desirable to be able to reduce the porosity of a smoking rod wrapper during storage and during part of the burning of the smoking rod but then reliably to allow the porosity to increase substantially as the burning tip approaches. If this could be achieved reliably it would facilitate the manufacture of smoking rods having a wide variety of ventilation characteristics, thereby permitting the production of optimum combinations of, for instance, any or all of flavour, strength, tar, carbon monoxide or nicotine levels at any particular stage in the combustion of the smoking rod.

According to one aspect of the invention a smoking rod wrapper material has porosity apertures within a coated area and the apertures are partially or fully blocked by a coating of a heat-removable porosity-reducing composition, and this composition comprises (a) 0 to 20% by weight polymeric binder and (b) 80 to 100% by weight of a non-polymeric material that is solid at 30° C. and that, at a temperature between 30° and 150° C., melts and is absorbed into the substrate or volatilises, and thereby leaves the apertures substantially unblocked.

As a result of the apertures becoming substantially unblocked, or opened, by exposure to the increased temperature there is a substantial increase in the porosity of the wrapper in the coated area. The increased temperature is caused by the approach of the burning tip and the porosity of the wrapper in the 10 mm behind the burning cone will generally be at least 50%, measured in Coresta, greater than the initial porosity of the coated area.

The invention can be applied to smoking rod wrappers having perforations of large dimensions, e.g., up to 250 μm or more, as in the typical prior art discussed above, but is of particular value when applied to wrappers in which the apertures that are to be blocked are all small, generally below about 100 μm, most preferably below about 80 μm. When the apertures are perforations the increase in porosity as the burning tip approaches is always large, e.g., more than 20 fold and often above 50 fold, but the invention is also of value with unperforated fibrous wrappers. In these, the apertures are the micropores between the fibres of the fibrous wrapper and the increase in porosity as the burning tip approaches is much less, e.g., 50 to 500%.

It is particularly preferred that the amount of porosity-reducing composition is low, generally 0.05 to 1 mg/cm$^2$, on a dry weight basis, and the combination of low amounts of composition and small or very small porosity apertures means that very careful control of combustion properties can be achieved without any visually undesirable effects on the wrapper during combustion.

According to a second aspect of the invention a porous smoking rod wrapper material has porosity apertures within a coated area in which the apertures are partially or fully blocked by a coating of heat-removable, porosity-reducing composition and the apertures have a maximum dimension of below about 80 μm and the amount of porosity-reducing composition is 0.05 to 1 mg/cm$^2$ and the composition melts or volatilises upon the approach of the burning tip whereby the coated area of the wrapper in the 10 mm behind the burning tip has a porosity at least 50%, measured in Corestas, greater than the initial porosity of the coated area.

Any composition that will provide the desired reduction in porosity at the low coating weight and that will provide the desired increase in porosity upon the approach of the burning cone can be used in this aspect of the invention. Preferably the composition contains little or no polymeric material and preferably the composition melts at a temperature of above 30° C., most preferably above 50° C. but generally below 150° C., most preferably below 120° C. The preferred compositions are compositions containing 0 to 20% by weight polymeric binder and 80 to 100% by weight of a non-polymeric material that is solid at 30° C. and that, at a temperature between 30° and 150° C. melts and is absorbed into the substrate or volatilises, thereby to leave the apertures substantially unblocked.

An important feature of the described compositions is that when the compositions melt the molten phase should be substantially entirely absorbed into the substrate. The substrate is usually a fibrous substrate and the coating of composition is preferably, initially, primarily on the surface of the substrate but then preferably wicks into the substrate when it melts. The porosity of the interior of the composition is preferably not substantially reduced as a result of this wicking, presumably because the molten composition migrates primarily to the fibre intersections without substantially forming films across the pores between fibres. Accordingly materials that are very viscous when molten (e.g., monosodium phosphate) are unsuitable as they will merely remain on the surface of the composition as a fluid, porosity-reducing, layer.

Instead of melting and wicking into the wrapper, the composition may alternatively be one in which most or all of it volatilises.

When the blocking material is one that volatilises, volatilisation may be preceded by degradation of the blocking material into volatile degradation products. Suitable volatilisable blocking materials are urea, malonic acid and derivatives (preferably salts, e.g., sodium malonate), solid β-keto acids, and solid aldehyde polymers (preferably metaldehyde).

Preferably however the blocking material is a material that melts and is substantially wholly absorbed into the substrate at the selected temperature of about 30° to about 150° C. If the melting point is too low then the composition will have a tendency to melt during storage or manufacture and for this reason it is generally preferred that the entire composition and the blocking material should both melt at a temperature of above about 40° C. or about 50° C., often above about 60° C. If the melting point of the blocking material and the entire composition is too high then the composition will not become adequately unblocked from the apertures as the burning tip approaches unless the apertures are very large and/or will not open sufficiently far from the approaching burn line to give adequate ventilation. Preferably therefore the composition and the blocking material both melt at below about 130° C. and most preferably below about 120° C. Best results are generally achieved with melting points of about 100° C. and below, e.g., about 60° to 100° C., often about 60° to 80° C. Similar temperatures are appropriate for the volatilisation temperature of volatilisable blocking materials.

The extent of absorption is affected by the permeability of the substrate but must be sufficient that the molten material substantially unblocks all the perforations. Generally the material must be non-polymeric in order for it to absorb satisfactorily into the paper. Preferably the appearance of the substrate does not significantly change when the composition melts.

Various organic materials have these properties but the preferred materials are aliphatic fatty alcohols, fatty acids or alkyl esters or salts thereof. The fatty acids and alcohols preferably contain from 10 to 20 carbon atoms. The acids may be monocarboxylic or dicarboxylic. The alkyl groups of the esters preferably contain 1 to 8, often 1 to 4, carbon atoms. The preferred materials are palmitic acid and salts thereof, either individually or as blends that have the desired melting point, preferably in the range 50° to 100° C. Suitable salts are potassium, sodium, ammonium, magnesium and calcium, although it is preferred for, e.g., calcium and potassium to be used in admixture with the free acid, in order to depress the melting point to the preferred value of around 100° C. or less. A preferred blocking material is a blend of palmitic acid with potassium palmitate in a molar ratio of at least 1:0.8, often 1:0.2 to 1:0.5.

When the blocking material is one that melts at the chosen temperature it is preferred for the molten material subsequently to volatilise, with or without prior degradation, at a temperature between 200° or 250° and 500° C., with the result that the material is initially absorbed into the wrapper and then volatilises, as the smoking tip approaches. The preferred materials, such as the palmitates, have this valuable property.

The blocking material may be used by itself if it is capable of forming a film across each aperture (i.e., of blocking each aperture) but it is often desirable to include a small amount of binder with the blocking material in order to promote formation of a film while the blocking material is solid. However the amount of binder must be low as otherwise on heating it will result in the apertures remaining blocked or will result in poor absorption of the blocking material into the substrate.

The compositions that are preferably used in the invention are therefore clearly distinguished from the typical compositions of the prior art that all consisted wholly or mainly of polymeric binder and in the invention the compositions must either be free of polymeric binder or must contain only a very low amount. We find that if the amount of ethylene vinyl acetate, ethyl cellulose or other binder is above about 20%, the composition does not adequately clear from the small apertures upon heating and preferably the amount of binder is always below 15% by weight of the composition. Generally the amount of binder is below 12% and most preferably it is not more than 10%. If binder is present the amount is usually at least 5%.

The binder should preferably be a material that has poor film-forming characteristics. Suitable materials are low molecular weight hydroxypropyl cellulose, methyl cellulose and hydroxyethyl cellulose but ethyl cellulose is preferred. Other suitable binders include ethylene vinyl acetate copolymers and polyvinyl alcohol.

The composition can contain materials additional to the binder and the organic blocking material provided these do not detract from the described properties of the composition. For instance although adequate properties can sometimes be achieved if the composition includes fine inorganic filler most filled compositions will tend to be absorbed, when molten, less satisfactorily into the wrapper and/or to leave an inorganic residue in the apertures, thereby tending to leave blockages within the apertures. Accordingly the compositions are preferably substantially free of inorganic filler and generally they are substantially free of all materials other than the binder and the blocking material and possible minor additives such as plasticisers for the binder.

The composition preferably is free of anything that will have significant organoleptic properties since the material is generally present solely to alter the porosity and is not present primarily to provide an artificial additive to the smoke.

In those wrappers (e.g., GB No. 2,094,611A) where an organoleptically useful additive has been printed on to the wrappers, the total coating weight in the region where the material is applied is generally 2 to 5 mg/cm$^2$ and this contrasts with the lower amounts, generally below 1 mg/cm$^2$, that are preferably used in the invention. The amount is generally at least 0.01 and usually above 0.05 and often at least 0.01 mg/cm$^2$ but it is generally unnecessary for it to be more than about 0.6 mg/cm$^2$ and best results are generally achieved with from 0.2 to 0.5, preferably 0.2 to 0.3, mg/cm$^2$ of the composition.

The coating is formed by applying the blocking composition in a liquid form that is such that the desired porosity reduction is achieved at the chosen coating weight. The liquid form is preferably a solution in a solvent that is then evaporated. The solvent may be water or aqueous organic, generally alcoholic, solvent but is preferably a substantially non-aqueous alcohol or other organic solvent. The liquid composition may be applied by spray, spread coating or printing, preferably by printing followed by spread coating to give a uniform film. Printing is preferably by gravure. The composition may include optional additives in order to adjust its rheology to make it suitable for printing.

Instead of applying from solution in a solvent the composition may be applied as a dispersion in a volatile liquid or may be applied dry, for instance as a melt by calendering, under conditions such that the composition forms a film across the apertures. For instance it may be applied using a chilled calender roll.

The coating may be mainly on the surface of the wrapper or may be partially or wholly impregnated into the wrapper.

The smoking rod wrapper is preferably selected from any of the known materials suitable for use as smoking rod wrappers and so is preferably a fibrous paper having inter-fibre pores such that the wrapper has a low porosity, generally below 200 Coresta and preferably below 150 Coresta, but generally above 5 and preferably above 20 Coresta.

In U.S. Pat. No. 2,992,647 the composition would have to extend over substantially the entire surface area of the wrapper in order to block all the perforations but in the invention the blocking composition is generally applied over part only of the surface area of the wrapper. Although it can be applied in other areas, best results are generally achieved when the coated area extends from adjacent the mouth end of the smoking rod (i.e., at the junction of the rod and the filter if there is a filter or at the mouth tip of the rod if there is no filter) for a distance of from about 5 or 10% to about 50% of the total length of the smoking rod. Generally the coated area extends from adjacent the mouth end by a distance of from about 15 to about 30% or 40% of the rod. Generally the coated area extends 10 to 25 or 30 mm from the mouth end. Generally the coated area is continuous but it may be printed as a discontinuous pattern if desired, especially when the apertures are perforations and the printing blocks all the perforations.

The coated area generally extends around the circumference of the rod.

The invention is of value wherever it is desired to provide changes in porosity of the rod as the burning tip moves along the rod but is of particular value in two situations, namely when the rod is provided with perforations near the mouth end with the intention of, for instance, reducing the normal change in tar content between the initial and final puffs, and when the wrapper is substantially unperforated and the coating is intended to increase tar delivery without increasing the ratio of carbon monoxide:tar and without significantly increasing the puff number of the smoking rod.

When the rod is perforated, the porosity of the wrapper is initially due primarily to the perforations and the porosity in the perforated area is typically in the range 1,000 to 10,000 Coresta. Preferably it is at least 2,000 Coresta and generally it is below 5,000 Coresta. The coated area, both before coating and after the heating that causes absorption or volatilisation of the coating, preferably therefore has porosity values within this range. While the rod is coated, i.e., during storage and before the approach of the burning tip, the porosity is preferably below 200 Coresta and is often below 30 Coresta. It is usually at least 5 Coresta.

The perforations generally have a diameter of at least 20 or 30 μm but generally not more than about 70 or 80 μm, with best results generally being obtained at around 50 μm. The perforations can be formed in any conventional manner for perforating paper substrates, e.g., in the same way as is used for perforating the wrapper of filters.

Perforations may extend along the entire length of the rod, generally with a greater density close the mouth end, but preferably substantially all the perforations are adjacent to the mouth end. For instance they may be distributed throughout an area extending from the mouth end by a distance of 10 to 50%, preferably 15 to 40%, of the length of the rod (e.g., 10 to 25 or 30 mm from the mouth end). The coated area preferably is substantially co-extensive with the perforated area.

The porosity in the coated area is often less than the porosity at the other end of the rod, because of the coating, and is typically in the range 15 to 40 Coresta whilst the uncoated area typically has a porosity at least double. When the rod starts burning the majority of the air is drawn through the rod, in a manner similar to a conventional uncoated and unperforated wrapper although the reduction in porosity adjacent the mouth end can be beneficial. As the smoking proceeds the amount of air drawn through the wrapper increases significantly due to the clearance of the blocked perforations as the smoking tip approaches. This results in increasing dilution of the smoke and the amount of tar in the later puffs is, as a proportion of the amount in the first puff, much less using the perforated wrappers of the invention than using unperforated wrappers or perforated wrappers of the prior art discussed above wherein the blocking material contains a large amount of film forming polymer.

The avantages of applying the invention to perforated wrappers are manifested in various ways. Whereas with conventional wrappers the user always finds that the second half gives a greater degree of strength, tobacco flavour, amount of tar and general smoking sensation than the first half, the perforated wrappers of the invention generally give first half values as high as or higher than the values with conventional wrappers and second half values that are about the same or slightly higher. Thus in the invention the properties that the user seeks are generally available more consistently and to a higher level than the values that are obtained through only the second half of conventional smoking rods.

The second situation in which the invention is of particular value is when the wrapper is a fibrous unperforated sheet, the porosity apertures then being the inter-fibre pores through the sheet. The coated area generally has a porosity below half of the porosity of the uncoated wrapper, generally below 60 Coresta but usually above 10 Coresta, generally 15 or 20 to 40 or 50 Coresta. The porosity of the uncoated wrapper is usually 30 to 150 Coresta and is usually two to four times the porosity of the coated wrapper. Best results are achieved when the coated area has a porosity of 15 to 40 Coresta and the uncoated wrapper has a porosity of at least double, generally 30 to 80 Coresta.

The coated area can extend along the entire length of the smoking rod but preferably extends only part way along the rod. For instance it may extend from the burning cone part way, for instance 50 to 95%, generally 70 to 85%, towards the mouth end. For instance a typical rod having a burning rod length of about 75 mm may be coated for from 50 to 65 mm, generally about 60 mm, from the burning tip end. However best results are achieved when the coated area extends part way from the mouth end towards the cone, generally 5 to 50%, preferably 15 to 30%, of the distance from a filter tip at the mouth end towards the cone end. Thus the typical 75 mm rod is preferably coated 10 to 25 mm from the mouth end, (i.e., 10 to 25 or 30 mm from the mouth end or from the filter tip if there is a filter tip). The reason for preferring this is that it requires the minimum weight of coating material for achieving maximum tar and minimum CO production.

As the burning cone approaches and passes through the coated area the porosity in the 10 mm closest to the cone increases by at least 50% and often at least 75% and often 100 or even 125% more than the porosity of the coated area. This increase may extend for up to 20 mm behind the burning cone. Because the porosity close behind the cone is much greater than initially the smoking rod can undergo free burn far more effectively than when the coated area has a uniform low porosity immediately behind the cone (as in U.S. Pat. No. 3,911,932) and the benefits of reduced porosity can be achieved without the disadvantages of increased CO:tar ratio and increased puff number (as are incurred in U.S. Pat. No. 3,911,932). Thus it is possible to increase tar delivery without increasing the ratio of carbon monoxide:tar and without significantly increasing the puff number of the smoking rod.

The total loading of coating material used in the invention is typically from 0.2 to 1 mg, often about 0.3 to 0.7 mg if it is applied at the mouth end and 1 to 4 mg, typically about 2.5 to 3.5, mg if it is applied at the cone end.

The invention includes continuous or other large sheets of wrapper material coated with the porosity-reducing composition and optionally having uncoated areas all as described above, with the areas being arranged such that wrappers as defined above can be cut from the sheets. For instance there may be transverse or longitudinally arranged bands of coated material separated by bands of uncoated material, each type of band either being of the width for one wrapper or being of a width for two wrappers (arranged with two adjacent coated areas separated by two adjacent uncoated areas). The invention also includes the individual wrappers, and smoking rods that include such wrappers.

The following are some examples. Examples 1 and 2 illustrate the application of the invention to unperforated wrappers and the remaining examples illustrate perforated wrappers.

EXAMPLE 1

Three cigarette rod wrappers having theoretical porosities of 50, 80 and 135 Coresta were given a continuous coating over 65 mm from the cone (lighting) end of 0.3 mg/cm$^2$ (dry weight) of a composition of 90% palmitic acid and 10% ethyl cellulose binder. The porosity of the coated part of each of the wrappers of these coated samples was recorded and the porosity of the initial wrapper was recorded, and the puff number, total tar delivery and the total carbon monoxide delivery was recorded for the coated sample and for the uncoated control. The results are shown in Table 1.

TABLE 1

| | 50 Coresta | | | | | |
|---|---|---|---|---|---|---|
| | Control | Sample | 80 Coresta Control | 80 Coresta Sample | 135 Coresta Control | 135 Coresta Sample |
| Porosity (Coresta) | 47 | 21 | 78 | 32 | 118 | 53 |
| Puff No. | 10.0 | 9.8 | 10.3 | 10.0 | 10.5 | 10.0 |
| Tar mg | 10.2 | 11.6 | 10.0 | 11.5 | 9.9 | 10.6 |
| CO mg | 10.3 | 10.5 | 9.6 | 9.4 | 7.4 | 10.3 |

As a comparison the 50 Coresta paper was given an overall coating for 65 mm from the cone end of 0.3 mg/cm$^2$ of carboxymethyl cellulose. The properties of the coated sample and the control are shown in Table 2.

TABLE 2

| | Control | Sample |
|---|---|---|
| Porosity (Coresta) | 47 | 5 |
| Puff No. | 10.0 | 13.2 |
| Tar mg | 10.2 | 16.6 |
| CO mg | 10.3 | 23.6 |

The ratio of the puff number of the sample to the puff number of the control is 0.98 in Example 1 and 1.32 in the comparison. The ratio of carbon monoxide to tar is 0.9 in Example 1 and 1.42 in the comparison. This clearly demonstrates the benefits of the systems of Example 1, using a very low amount of binder, compared to the comparison using the same amount of a composition but in which the composition consists of binder.

EXAMPLE 2

A result similar to Example 1 can be achieved by applying the same coating material by the same technique and at the same density but over a distance of only about 15 mm from where the burning rod is connected to a filter tip.

EXAMPLE 3

Paper having a porosity of 80 Coresta is perforated in an area with 450 holes 100 μm by 100 μm per square centimetre to give a porosity of 2000 Coresta. It is then gravure printed in the perforated area on one surface with a composition consisting of 9 parts by weight ammonium palmitate, 1 part ethyl cellulose and 18 parts ethanol at a dry weight of about 0.2 mg/cm$^2$. Whilst still wet the coating is spread, to give a uniform film over the entire surface. It is then used to make smoking rod wrappers for rods having a length of 75 mm and provided with a filter, with the coated area being the 6 cm$^2$ adjacent the mouth end (i.e., covering about one third of the length of the rod). The rod was then smoked. The composition had a melting point of 102° C. and caused the perforations to open up to 10 mm behind the cigarette burn line. The tar and nicotine delivery, on a puff by puff basis, was recorded for this ventilated rod and, as a comparison, for a rod made from the same wrapper material but without the perforations or coating. The results are in Table 3.

TABLE 3

| | Non-Ventilated Wrapper | | Ventilated Wrapper | |
|---|---|---|---|---|
| Puff No. | Tar mg | Nicotine mg | Tar mg | Nicotine mg |
| 1 | 1.3 | 0.12 | 1.2 | 0.09 |
| 2 | 1.6 | 0.17 | 1.2 | 0.12 |
| 3 | 1.6 | 0.18 | 1.2 | 0.15 |
| 4 | 1.7 | 0.19 | 1.3 | 0.16 |
| 5 | 1.9 | 0.20 | 1.4 | 0.18 |
| 6 | 2.0 | 0.22 | 1.4 | 0.20 |
| 7 | 2.1 | 0.23 | 1.4 | 0.21 |
| 8 | 2.2 | 0.25 | 1.5 | 0.23 |
| 9 | 2.2 | 0.25 | 1.6 | 0.25 |
| 10 | 2.4 | 0.27 | 1.7 | 0.26 |
| Total | 19.0 | 2.08 | 13.9 | 1.85 |

EXAMPLE 4

Wrapper material was perforated in an area with perforations about 50 μm diameter to give a porosity of about 2000 Coresta, and was then coated with a solution of blocking material, binder and ethanol to a dry weight of 0.2 mg/cm$^2$, broadly as in Example 3. The perforated and coated areas were the 6 cm$^2$ adjacent the mouth end of the rods made from the wrappers. The ratio by weight of tar in the first puff to tar in the final puff was recorded. The binder was selected from ethyl cellulose (ec) and ethylene vinyl acetate (eva) and the amount of it as % dry weight of the composition, and the results, are shown in Table 4.

TABLE 4

| Blocking material | Binder | % Binder | Melting point °C. | tar first: last puff |
|---|---|---|---|---|
| Palmitic acid | ec | 10 | 63 | 1:1.3 |
| Palmitic acid 0.25 K salt | ec | 10 | 68 | 1:1.5 |
| Palmitic acid 0.5 K salt | ec | 10 | 138 | 1:2.3 |
| Palmitic acid 0.75 K | ec | 10 | >200 | 1:2.7 |
| Palmitic acid | ec | 25 | 63 | 1:2.7 |
| Palmitic acid | eva | 25 | 63 | 1:2.7 |
| Metaldehyde | ec | 10 | <115 (volatile) | 1:2.0 |
| Octadecanoic acid ethyl ester | ec | 10 | 34 | 1:1.2 |
| Octadecanoic acid methyl ester | ec | 10 | 39 | 1:1.2 |
| Tetradecanol | ec | 10 | 40 | 1:1.2 |
| Hexadecanol | ec | 10 | 50 | 1:1.2 |
| Tetradecanoic acid | ec | 10 | 54 | 1:1.2 |
| Octadecanol | ec | 10 | 59 | 1:1.2 |
| Octadecanoic acid | ec | 10 | 70 | 1:1.5 |
| Hexadecanoic acid 0.38 K salt | ec | 10 | 98 | 1:1.7 |
| Malonic acid | ec | 10 | 135 | 1:2.2 |

The ratio should be as close as possible to 1:1 and os these results demonstrate the value, for wrappers having small perforations, of the use of a low melting point blocking material and low amounts of binder. We find that the ratio of mg tar first:last puff remains substantially constant at binder levels up to about 12% and then starts to deteriorate so that by about 20% it has become significantly worse and by 25% there is substantially no useful clearance of the apertures.

EXAMPLE 5

80 Coresta paper was perforated by 50 μm perforations to 1,000; 1,500; 2,500 and 3,000 Coresta and coated with 90% palmitic acid 10% ethyl cellulose at a loading of 0.2 mg/cm$^2$ over an area of 6 cm$^2$ at the filter end of a cigarette. By comparison of puff×puff tar deliveries with those of an unperforated control cigarette per puff ventilations were calculated and are in Table 5.

TABLE 5

| | Wrapper Ventilation Level % | | | |
|---|---|---|---|---|
| Puff No. | 1,000 Coresta | 1,500 Coresta | 2,500 Coresta | 3,000 Coresta |
| 1 | 17 | 18 | 18 | 19 |
| 2 | 19 | 21 | 21 | 22 |
| 3 | 21 | 21 | 22 | 23 |
| 4 | 19 | 20 | 20 | 21 |
| 5 | 18 | 19 | 18 | 19 |
| 6 | 24 | 25 | 27 | 32 |
| 7 | 30 | 34 | 38 | 43 |
| 8 | 33 | 38 | 45 | 55 |
| 9 | 33 | 38 | 45 | 55 |
| 10 | 33 | 38 | 45 | 55 |
| 11 | 27 | 36 | 43 | 51 |

The increase in ventilation in the later puffs, especially in the more highly perforated wrappers, is clearly shown and is beneficial.

EXAMPLE 6

Rods made using a perforated wrapper as in Example 5 (2,500 Coresta) were compared against conventional rods, in which only the filter was perforated, by a smoking panel who allocated a numerical value to each observed descriptor (or sensation) for the first and second half or each cigarette, the higher values being desired. The results are in Table 6.

TABLE 6

| | Conventional | | Invention | |
|---|---|---|---|---|
| Descriptor | 1st Half | 2nd Half | 1st Half | 2nd Half |
| Degree of strength | 3.02 | 3.42 | 3.42 | 3.90 |
| Quantity of tobacco taste | 3.65 | 4.03 | 4.18 | 4.58 |
| Smoke received per puff | 4.50 | 5.05 | 5.06 | 5.14 |
| Amount lung chest sensation | 2.70 | 3.64 | 3.50 | 4.18 |
| Peppery prickly heat in mouth | 4.12 | 5.15 | 4.40 | 4.55 |
| Scratches back of throat | 3.24 | 4.11 | 3.94 | 3.85 |
| 1st puff throat scratch | 3.36 | — | 4.09 | — |
| Prickliness increases on smoking | — | 4.93 | — | 4.36 |

This demonstrates the remarkable fact that although the tobacco content is the same in both types, the smoking rods of the invention give performance in both halves generally as good as or better than the smoking performance in the second half of the conventional rods.

We claim:

1. A smoking rod wrapper material having porosity apertures within a coated area in which the apertures are partially or fully blocked by a coating of a heat-removable porosity-reducing composition, and in which the composition comprises (a) 0 to 20% by weight polymeric binder and (b) 80 to 100% by weight of a non-polymeric blocking material that is solid at 30° C. and that, at a temperature between 30° and 150° C., melts and is absorbed into the substrate or volatilises, and thereby leaves the apertures substantially unblocked, the porosity apertures being below 100 μm in diameter and the amount of the composition in the coated area is 0.05 to 1 mg/cm$^2$.

2. A material according to claim 1 in which the coated area is located in a position that will extend from adjacent the mouth end of the smoking rod by a distance of 15 to 30% of the length of the rod.

3. A smoking rod wrapper material having porosity apertures within a coated area in which the apertures are partially or fully blocked by a coating of a heat-removable porosity-reducing composition and in which the apertures have a maximum dimension of below 80 μm, the amount of the composition in the coated area is 0.05 to 1 mg/cm$^2$ and the composition will melt or volatilise upon the approach of the burning tip of the smoking rod, whereby the coated area of the wrapper in the 10 mm behind the burning tip will have a porosity at least 50%, measured in Corestas, greater than the initial porosity of the coated area.

4. A material according to claim 3 and which has perforations within the coated area blocked by the composition and in which the material in that area in the absence of the coating has a porosity of 1,000 to 10,000 Coresta and in which the coated area has a porosity of below 200 Coresta, and in which the perforations preferably have a diameter of 20 to 70 μm.

5. A material according to claim 3 that is a fibrous unperforated sheet having an uncoated porosity of 20 to 200 Coresta and in which the porosity apertures are inter-fibre pores through the wrapper sheet, and in which the coated area has a porosity of below 60 Coresta and that is less than one half its porosity before application of the coating.

6. A material according to claim 3 in which the coated area is located in a position that will extend from adjacent the mouth end of the smoking rod by a distance of 15 to 30% of the length of the rod.

7. A material according to claim 3 in which the coated area is located in a position that will extend from adjacent the mouth end of the smoking rod by a distance of 15 to 30% of the length of the rod.

8. A material according to claim 3 in the form of a wrapper around a smoking rod.

9. A smoking rod having a wrapper, in which the wrapper is material according to claim 3.

10. A smoking rod wrapper material having porosity apertures within a coated area in which the apertures are partially or fully blocked by a coating of a heat-removable porosity-reducing composition and in which the apertures have a maximum dimension of below 80 μm, the amount of the composition in the coated area is 0.05 to 1 mg/cm$^2$ and the composition will melt or volatilise upon the approach of the burning tip of the smoking rod, whereby the coated area of the wrapper in the 10 mm behind the burning tip will have a porosity at least 50%, measured in Corestas, greater than the initial porosity of the coated area and in which the porosity-reducing composition comprises (a) 0 to 20% by weight polymeric binder and (b) 80 to 100% by weight of a non-polymeric blocking material that is solid at 30° C. and that, at a temperature between 30° and 150° C., melts and is absorbed into the substrate or volatilises.

11. A smoking rod wrapper material having porosity apertures within a coated area in which the apertures are partially or fully blocked by a coating of a heat-removable porosity-reducing composition, and in which the composition comprises (a) 0 to 20% by weight polymeric binder and (b) 80 to 100% by weight of a non-polymeric blocking material that is solid at 30° C. and that, at a temperature between 30° and 150° C., melts and is absorbed into the substrate or volatilises, and thereby leaves the apertures substantially unblocked, the non-polymeric blocking material being a fatty alcohol, fatty acid ester, fatty acid or fatty acid salt or a mixture thereof.

12. A material according to claim 11 in which the blocking material is selected from the group consisting of palmitic acid and salts thereof.

13. A material according to claim 11 in which the blocking material is selected from the group consisting of palmitic acid, ammonium palmitate and mixtures of palmitic acid with potassium palmitate in a molar ratio of above 1:0.8.

14. A material according to claim 11 in which the composition melts or volatilises at a temperature of between 50° and 120° C.

15. A material according to claim 8 in which the composition melts or volatilises at a temperature of between 60° and 100° C.

16. A material according to claim 11 in which the amount of polymeric binder in the composition is from 0 to 15% by weight of the composition.

17. A smoking rod wrapper material having porosity apertures within a coated area in which the apertures are partially or fully blocked by a coating of a heat-removable, porosity-reducing composition, and in which the composition comprises (a) 5 to 20% by weight polymeric binder and (b) 80 to 95% by weight of a non-polymeric blocking material that is solid at 30° C. and that, at a temperature between 30° and 150° C., melts and is absorbed into the substrate or volatilises, and thereby leaves the apertures substantially unblocked.

18. A material according to claim 17 and which has perforations within the coated area blocked by the composition and in which the material in that area in the absence of the coating has a porosity of 1,000 to 10,000 Coresta and in which the coated area has a porosity of below 200 Coresta, and in which the perforations preferably have a diameter of 20 to 70 μm.

19. A material according to claim 17 and which has perforations in the coated area blocked by the composition and the perforations have a diameter of 20 to 70 μm.

20. A material according to claim 17 that is a fibrous unperforated sheet having an uncoated porosity of 20 to 200 Coresta and in which the porosity apertures are inter-fibre pores through the wrapper sheet, and in which the coated area has a porosity of below 60 Coresta and that is less than one half its porosity before application of the coating.

21. A material according to claim 17 that is unperforated and in which the coated area has a porosity of from 15 to 40 Coresta and the uncoated area has a porosity that is at least twice the porosity of the coated area.

22. A material according to claim 17 that is unperforated and in which the coated area is located in a position that will extend from adjacent the mouth end of the smoking rod by a distance of from 5 to 50% of the length of the rod.

23. A material according to claim 17 in which the coated area is located in a position that will extend from adjacent the mouth end of the smoking rod by a distance of 15 to 30% of the length of the rod.

24. A material according to claim 17 in the form of a wrapper around a smoking rod.

25. A smoking rod having a wrapper, in which the wrapper is material according to claim 17.

26. A material according to claim 17 in which the amount of polymeric binder is 5 to 15% by weight of the composition.

27. A material according to claim 17 in which the non-polymeric blocking material is a fatty alcohol, fatty acid ester, fatty acid or fatty acid salt or a mixture thereof.

28. A material according to claim 17 in which the blocking material is selected from the group consisting of palmitic acid and salts thereof.

29. A material according to claim 17 in which the blocking material is selected from the group consisting of palmitic acid, ammonium palmitate and mixtures of palmitic acid with potassium palmitate in a molar ratio of above 1:0.8.

30. A material according to claim 17 in which the composition melts or volatilizes at a temperature of between 50° and 120° C.

31. A material according to claim 30 in which the composition melts or volatilizes at a temperature of between 60° and 100° C.

* * * * *